US008528372B2

(12) United States Patent
Nilsson

(10) Patent No.: US 8,528,372 B2
(45) Date of Patent: Sep. 10, 2013

(54) ALARM DEVICE

(75) Inventor: Thomas Nilsson, Malmo (SE)

(73) Assignee: MW Security AB (SE)

( * ) Notice: Subject to any disclaimer, the term of this patent is extended or adjusted under 35 U.S.C. 154(b) by 186 days.

(21) Appl. No.: 13/055,065

(22) PCT Filed: May 20, 2009

(86) PCT No.: PCT/EP2009/056184

§ 371 (c)(1),
(2), (4) Date: May 16, 2011

(87) PCT Pub. No.: WO2010/009916

PCT Pub. Date: Jan. 28, 2010

(65) Prior Publication Data

US 2011/0308283 A1 Dec. 22, 2011

(30) Foreign Application Priority Data

Jul. 22, 2008 (SE) ..... 0801723

(51) Int. Cl.
*E05B 73/00* (2006.01)

(52) U.S. Cl.
USPC ..... 70/57.1; 70/49; 70/63; 70/276; 70/413; 70/DIG. 49; 242/382; 340/572.9

(58) Field of Classification Search
USPC ..... 70/DIG. 49, 57.1, 18, 30, 49, 63, 70/233, 276, 413, 14, 58, DIG. 9; 242/382, 242/382.1, 382.4, 396.4, 385, 384.7, 378.1, 242/385.1, 385.2, 385.3, 385.4; 340/542, 340/568.2, 652, 571, 572.9, 568.4, 568.1, 340/568.3, 572.6
See application file for complete search history.

(56) References Cited

U.S. PATENT DOCUMENTS 3,643,250 A 2/1972 Sander
5,367,289 A 11/1994 Baro (Continued)

FOREIGN PATENT DOCUMENTS

EP 1593803 A1 11/2005
EP 1870547 A1 12/2007

(Continued)

OTHER PUBLICATIONS

"International Application Serial No. PCT/EP2009/056184, Written Opinion mailed Oct. 23, 2009", 5 pgs.
"Swedish Application Serial No. 0801723-8, ITS mailed Jan. 15, 2009", 10 pgs.
"International Application Serial No. PCT/EP2009/056184, International Search Report mailed Oct. 23, 2009", 3 pgs.

(Continued)

*Primary Examiner* — Lloyd Gall
(74) *Attorney, Agent, or Firm* — Schwegman Lundberg & Woessner P.A.

(57) ABSTRACT

Security device comprising a clasping member that comprises a conducting member, a locking member connected to the clasping member, such that the locking member and the clasping member form a loop, the locking member in turn comprising: a gear member comprising a protruding profile, the gear member extending in a first plane with the protruding profile raised from the first plane, a maneuvering member extending in a second plane parallel to the first plane, the maneuvering member being rotatable relative the gear member and comprising a latch member biased towards the first plane arranged to engage the gear member, such that rotation of the maneuvering member in opposite directions causes a narrowing or a widening of the loop. Rotation in a opposite direction is prevented through the engagement of the latch member with the protruding profile.

13 Claims, 7 Drawing Sheets

(56) References Cited

U.S. PATENT DOCUMENTS

| | | | | |
|---|---|---|---|---|
| 5,722,266 | A | 3/1998 | Yeager et al. | |
| 7,685,850 | B2 * | 3/2010 | Nilsson | 70/18 |
| 7,984,629 | B2 * | 7/2011 | Xiaobin | 70/57 |
| 8,087,269 | B2 * | 1/2012 | Conti et al. | 70/14 |
| 8,281,626 | B2 * | 10/2012 | Conti et al. | 70/57.1 |
| 8,347,663 | B2 * | 1/2013 | Fawcett et al. | 70/57 |
| 2002/0171550 | A1 | 11/2002 | Hirose et al. | |
| 2006/0053845 | A1 | 3/2006 | Benda et al. | |
| 2006/0169008 | A1 | 8/2006 | Fawcett | |
| 2008/0100457 | A1 | 5/2008 | Gray | |

FOREIGN PATENT DOCUMENTS

| | | | |
|---|---|---|---|
| GB | 2237913 | A | 5/1991 |
| WO | WO-95/01111 | A1 | 1/1995 |
| WO | WO-97/19241 | A1 | 5/1997 |
| WO | WO-2005/118992 | A2 | 12/2005 |

OTHER PUBLICATIONS

"Russian Application Serial No. 2011106508, Decision on grant mailed Feb. 11, 2013", English Translation, 4 pgs.

* cited by examiner

ALARM DEVICE

RELATED APPLICATIONS

This application is a nationalization under 35 U.S.C. 371 of PCT/EP2009/056184, filed May 20, 2009 and published as WO 2010/009916 A1 on Jan. 28, 2010, which claimed priority to Sweden Patent Application No. 0801723-8, filed Jul. 22, 2008; which applications and publication are incorporated herein by reference in their entirety.

TECHNICAL FIELD

The present invention is related to the field of security devices. More specifically it is related to alarm devices activating an alarm when a force is applied to one part of the alarm device.

BACKGROUND ART

Today a number of security devices for protecting goods inside containers exist on the market. Some are RFID (Radio Frequency Identification)-based preventing thieves leave the shop with the container, while others are related to security devices enclosing the container, thus preventing the opening of the container and taking of the goods inside it.

One example of a latter device is given in U.S. Pat. No. 5,722,266.

U.S. Pat. No. 5,722,266 discloses a security device that includes a plurality of wires or cables which encircle and lock all six sides of a box or the similar. The cable extends between a ratchet member which includes a gear with a plurality of teeth and a one-way pawl which engages the teeth, and a locking member remote from the ratchet member which includes a fastener which snap-fits to a base and requires an unlocking tool to unlock. The device is adjustable to tighten around different sizes of the goods to be protected. However, the device is complex in terms of construction and operation.

One improvement of the security device in U.S. Pat. No. 5,722,266 is the security wrapper described in the published European patent application EP1870547 by the same applicant as the present patent application.

The security wrapper in EP1870547 comprises essentially a rotatable locking member, a retaining member in the form of a wire which may be placed around the object to be protected, whereby the locking member by means of rotation is arranged to tighten the wire loop around the object. Locking of the rotatable locking member is achieved by means of a first and a second main part, whereby the latch member of the gear member is arranged to fasten into the teeth arranged in the second latch member. A container thus secured may only be opened by means of a detachment device which by magnetic pull raises the latch member from the teeth of the second part.

While being an improvement over present technology on the market it would still be desirable to further improve the reliability of the security device in case outer force is applied to it.

SUMMARY OF THE INVENTION

The present invention solves this problem by means of a security device which comprises a security device comprising: a clasping member for enclosing an object to be secured, whereby clasping member comprises a conducting member; a locking member connected to the clasping member, such that the locking member and the clasping member form a loop, where the locking member in turn comprises a gear member which in turn comprises a protruding profile, the gear member extending in a first plane with a protruding profile raised from the first plane, furthermore a manoeuvring member extending in a second plane parallel to the first plane, where the manoeuvring member is rotatable relative the gear member and comprises a latch member biased towards the first plane arranged to engage the gear ring, such that rotation of the manoeuvring member in one direction causes a narrowing of the loop whereas rotation in the opposite direction causing a widening of the loop is prevented through the engagement of the latch member with protruding profile, where the security device further comprises a drum for winding up the clasping member such that rotation of the manoeuvring member causes rotation of the drum and thereby adjustment of the width of the loop, the clasping member and the locking member further forming part of an alarm circuit whereby the locking member further comprises a movable element electrically connected to the alarm circuit and positioned next to an elastic element, so that an external pulling force applied to the clasping member with the locking member locked in one of the elements of the protruding profile causes a movement of the movable element towards the elastic element deforming the latter and thereby interrupting the alarm circuit and activating an alarm signal.

The advantage of such a security device lies in the improved security against use of a pulling force in order to pull the clasping member with which the object is protected out of the security device. Also moderate use of pulling force will activate an alarm.

However, accidental pulling of the clasping member will not result in alarms, thus preventing false alarms.

These and other advantages will become more apparent through study of the detailed description below.

DETAILED DESCRIPTION

The present patent application is based on the earlier European patent application EP1870547. Therefore, elements in the Figures described below which are identical to those in EP1870547 will not be described in detail in order to increase readability of the description.

Figure 1:
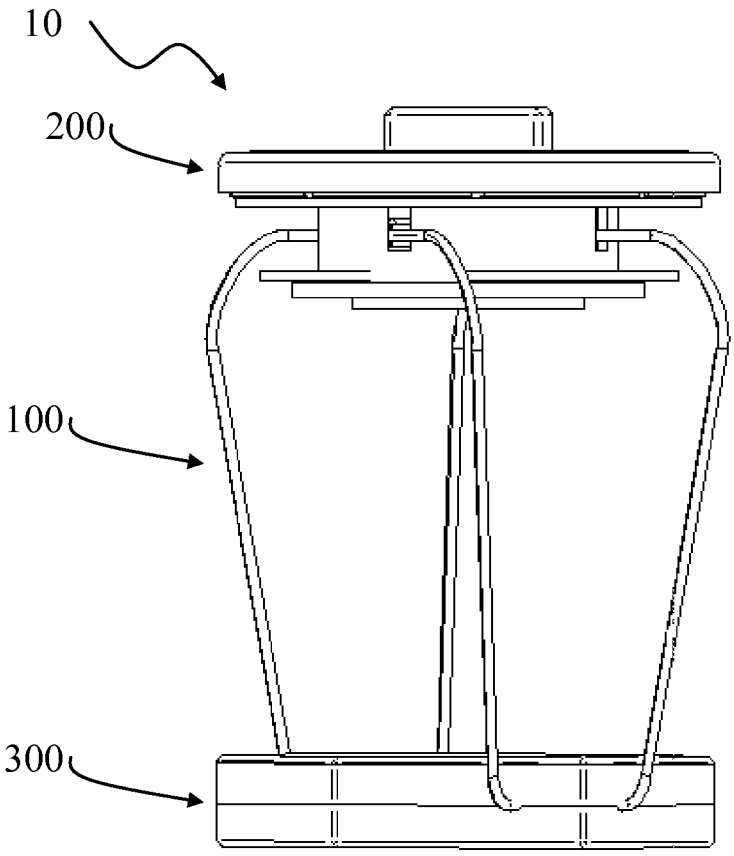
FIG. 1 illustrates a perspective side view of an embodiment of the security device according to the present invention.

FIG. 1 illustrates a perspective side view of the security device 10 comprising a clasping member 100, a locking member 200 and a support member 300.

The clasping member 100 is secured both in the locking member 200 and the support member 300 forming a loop into which an object to be secured can be brought. The width of the loop around the object to be secured may be adjustable by turning the locking member 200 in order to fit the dimensions of the object and to tightly enclose the object. Details on how this will be achieved will be explained later.

Figure 2:
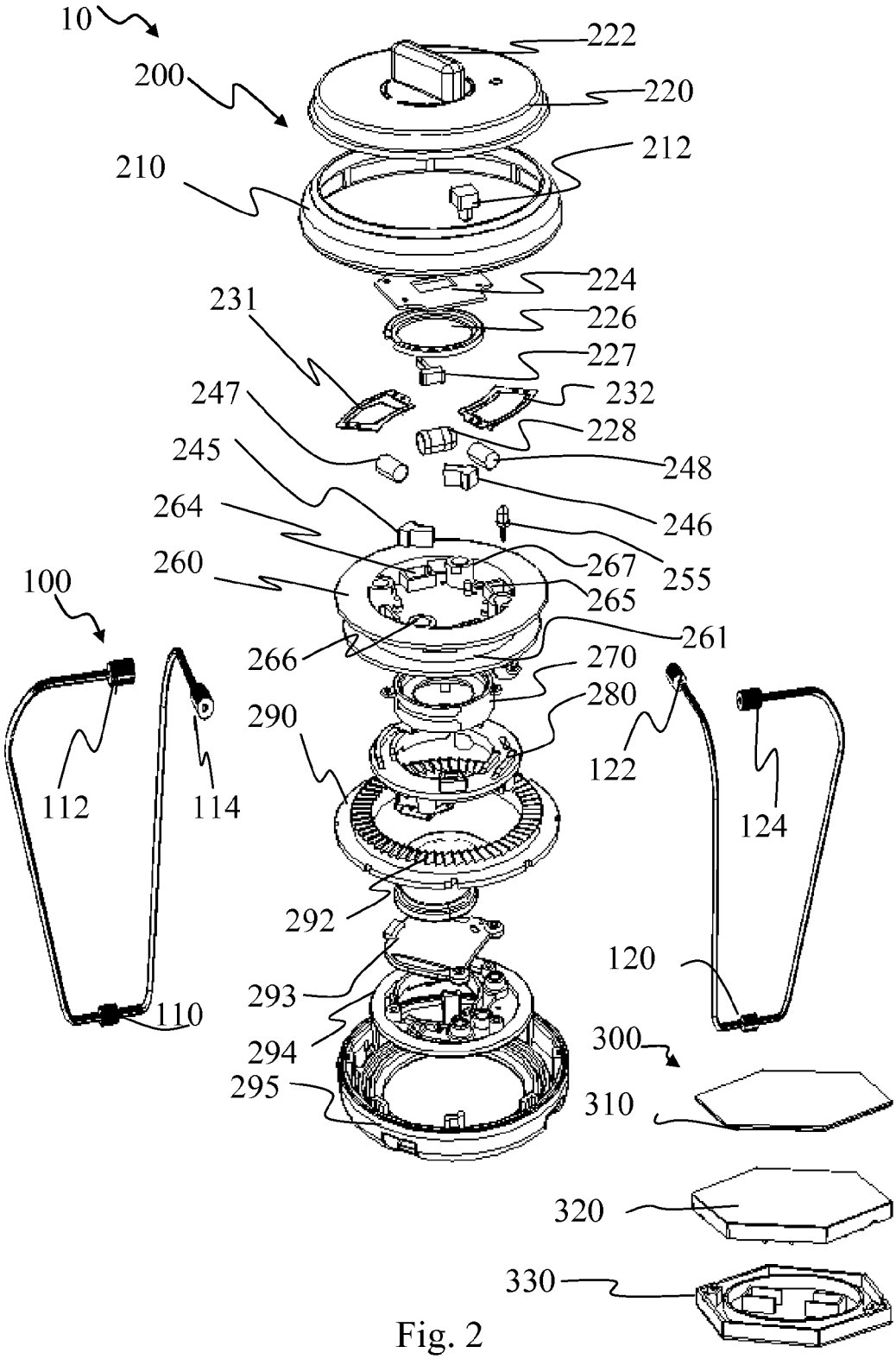
FIG. 2 illustrates an exploded perspective view of an embodiment of the locking member according to the present invention.

FIG. 2 illustrates an exploded perspective view of one embodiment of the security device 10 from a first angle.

As shown in the figure, the clasping member 100 may comprise one or more cables 110, 120 comprising enlarged cable ends 112, 114 and 122, 124 via which the cables are attached to the locking member 200. The cables 110, 120 are arranged to form an electrical alarm circuit together with the locking member 200 which will be described later. While the clasping member 100 in FIGS. 1-4 comprises two cables it may be understood that it may also comprises a single cable or more than two cables, as needed.

As seen in FIG. 1, the locking member 200 comprises an essentially annular gear member 290 extending in a first plane where at least a portion of the annular gear member 290 comprises an annular protruding profile 292 protruding from the first plane. In the embodiment in FIG. 1 this protruding profile is illustrated as a saw-tooth profile covering a part of the gear member 290. Additionally, the gear member 290 comprises recesses at its periphery which may be snap fit into the protruding elements in the bottom part 295.

Moreover, the locking member 200 further comprises an essentially circular manoeuvring member 220 which is rotatable relative to the gear member 290 and arranged in a second plane parallel to the first plane. The manoeuvring member 220 also comprises a gripping portion 222 vertically protruding from the locking member 200 for facilitating rotation of the manoeuvring member 220 relative to the gear member 290 when adjusting the loop formed by the cable ends 112, 114 and 122, 124 around an object to be secured.

Furthermore, the manoeuvring member 220 comprises latch members 231, 232, T-shaped movable elements 245, 246 and the elastic elements 247, 248 all arranged on a side of the locking member 220 opposite the gripping portion 222 as seen in FIG. 2.

In the embodiment illustrated, the latch members 231, 232 are curved with a radius of curvature essentially equal to the radius of curvature of the protruding profile 292. Both latch members 231, 232 are spaced apart in the second plane and inclined from the second plane towards the protruding profile 292 in the first plane. In this fashion the latch members 231, 232 are adapted to glide over the teeth of the protruding profile 292 when the manoeuvring member 220 is rotated in one direction relative to the gear member 290 and to lock into the teeth of the protruding profile 292 when rotated in the opposite direction. Moreover, the latch members are made of metallic and flexible material in order to be able to be raised from the protruding profile 292 by means of a magnetic attraction force. In this fashion the security device 10 can be unlocked and detached from the object using a so called magnetic detacher (not shown) which may be placed on top of the locking member 200 thereby separating the latch member 231, 232 from the teeth of the protruding profile 292. Such a detacher is already known from the European application EP1870547.

On the other hand, the T-shaped movable elements 245, 246 and the elastic elements 247, 248 follow the curvature of the second part 210 and are in this embodiment arranged in the curved grooves 241, 242 protruding from the lower surface of the manoeuvring member 220. Also, the T-shaped movable elements 245, 246 are in contact with the elastic elements 247, 248.

In addition, the manoeuvring member 220 comprises spaces 243, 244 which are adapted for receiving activation protrusions 288, 289 from an activation member 280 therein. This is more clearly shown in FIG. 5. On the inside surface of the grooves 241, 242 metal contacts 249, 250 are arranged which in the default position are electrically connected to the T-shaped movable elements 245, 246 in the fashion shown in FIG. 6. Also, the T-shaped movable elements 245, 246 comprise an electrically conducting coating or part (not shown) which in the non-activated state of the alarm is in electrical contact with the metal contact 249, 250 thus also comprising part of the alarm circuit.

Additionally, the locking member 200 comprises a drum 260 with a circumferential surface 261 onto which the cables 110, 120 of the clasping member 100 may be wound. In the circumferential surface 261 of the drum 260 apertures 262, 263 are located through which the cables 110, 120 are led to the interior of the drum 260. In the interior of the drum stables 264, 265 connecting the cable ends 112, 122, 114, 124 to a contact plate 224 made of metal and located on the bottom surface of the drum 260 are located. Via the contact plate 224 and the stables 264, 265 the cables 110, 120 of the clasping member 100 form an alarm circuit. Additionally, the alarm circuit comprises a capacitor 228 housed in the interior of the drum 260 which in the event of a breaking of the alarm circuit discharges a current causing a membrane in a sound chamber 270 to produce the alarm sound. The sound chamber 270 also comprises a guide ring 226 for the membrane of the sound chamber 270.

Also, the drum 260 comprises bores 266, 267 for receiving an activation member 280 therein.

The activation member 280 in the embodiment in FIGS. 2-7 is essentially circular in shape and comprises legs 283, 284 protruding from one side of the activation member 280 and adapted to be fitted into the bores 266, 267 of the drum 260. Moreover, the activation member 280 comprises activation elements 288, 289 protruding from a side of opposite the legs 283, 284 of the activation member 280 and adapted to be fitted into the spaces 243, 244 of the grooves 241, 242 in the manoeuvring member 220.

Hence, the activation member 280 may be connected to the manoeuvring member 220 by inserting the activation elements 288, 289 into the spaces 243, 244 and the legs 283, 284 into the corresponding bores 266, 267 of the drum 260. In this fashion, rotation of the manoeuvring element 220 is transferred to the activation element 280 and thus also to the drum 260 when the manoeuvring member 220 is rotated in the non-locking direction relative the gear member 290. Rotation of the manoeuvring member 220 in the locking direction however, will be stopped due to the engagement of the latch members 231, 232 in the teeth of the protruding portion 292 of the gear member 290.

Here, the non-locking rotation direction may be defined as the direction in which the manoeuvring member 220 is rotated relative to the gear member 290 when the latch members 231, 232 glide over the teeth of the protruding profile 292. Conversely, the locking rotation direction may be defined as the direction where rotation of the manoeuvring member 220 results in the locking of the latch member 231, 232 into the teeth of the protruding profile 292 of the gear member 290.

Figure 3:
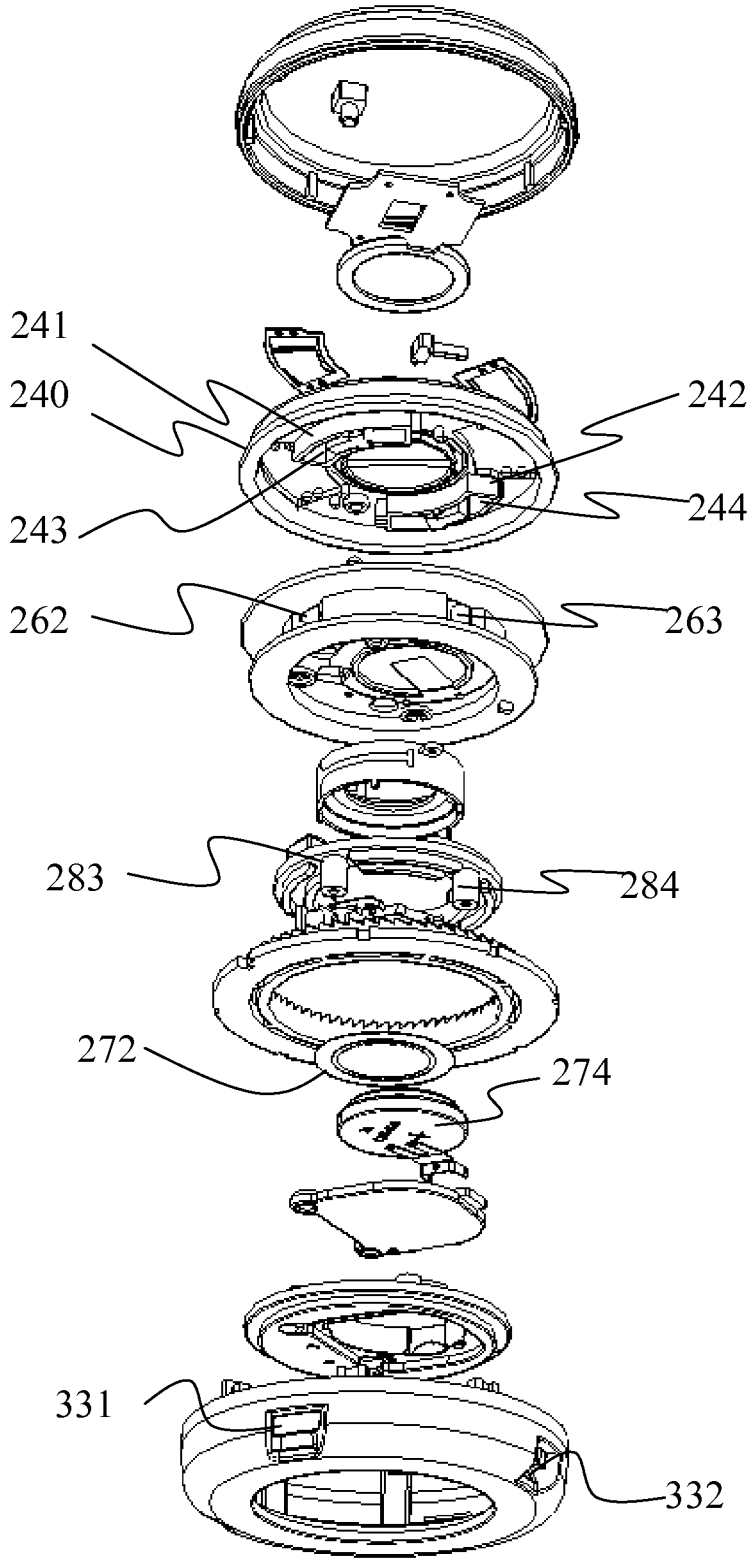
FIG. 3 illustrates an exploded perspective view of the locking member from FIG. 1 from a different angle.
Figure 4:
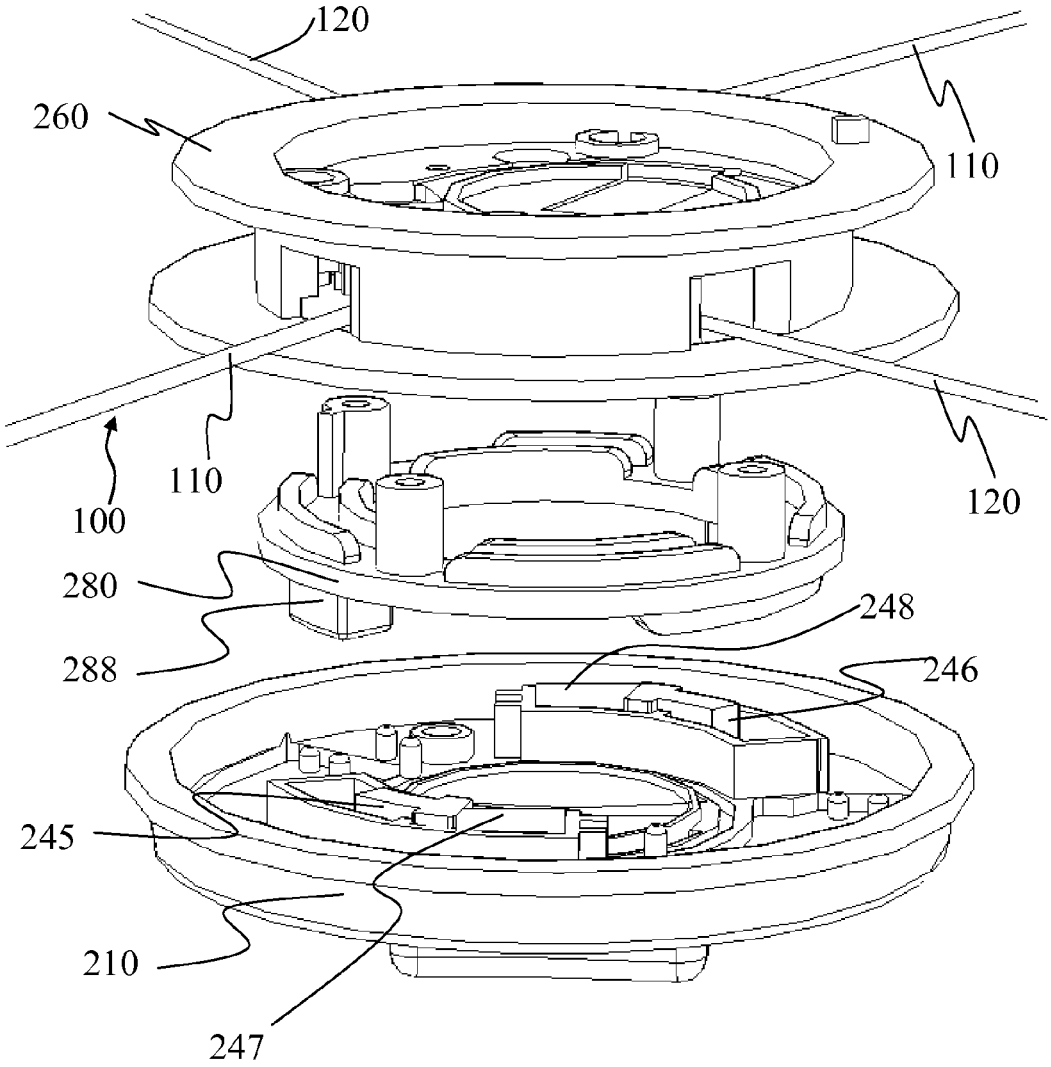
FIG. 4 illustrates a part of the locking member according to the present invention, with the alarm not activated.

In addition the locking member 200 further comprises a battery 274 housed in the lower part of the drum 260 as shown in FIG. 3. Also, the battery is connected to a connector 227.

In order to show the power status of the battery 274 for the alarm circuit, a LED diode 255 is arranged through an opening in the manoeuvring member 220.

There are many different ways to indicate the status of the battery 274, of which a LED-diode is only one example. A skilled person should be well aware of other ways of battery status indication and therefore these will not be elaborated further.

Finally, the locking part 200 comprises an annular shaped bottom element 295 having an essentially flat portion located in a third plane parallel with the first and second planes and a bowl shaped protruding portion raising from the flat portion which together with an outer ring 210 and the manoeuvring member 220 is arranged to form a housing and to contain and protect the remaining elements of the security device 10. Moreover, the locking part 200 comprises a cover plate 293 arranged to be attached to bore holes in a bottom plate 294 which is to be fitted into the bottom portion of the bottom element 295. In addition, the annular shaped bottom element comprises openings through which the clasping member 100 may be transported to the supporting element 300.

The support member 300 in turn is assembled by snap fitting the protruding sections of the cables into stables or the like arranged in the housing section 330 and arranging an EAS tag in the housing section 330. The housing section is closed off by a top section 320 fastened to the housing section e.g. by a snap lock fit, fastening elements, gluing, welding or the like. The housing section 330 and the top section have in an embodiment of the invention recesses in the circumferential sides arranged to fit the cables 110, 120. The illustrated support member 300 is in hexagonal shape but may be in any suitable shape, such as circular, rectangular or the like. It should also be understood that the EAS-tag may be contained in the locking member 200.

Finally, when the cables 110, 120 are secured in the housing section 330 and the housing section is sealed of by the top section 320, the friction layer 310 is provided to the top section 320, either by gluing it, welding it or the like, to the top section 320. This may also be done in a separate process, whereby the top section 320 and the friction layer 310 are assembled before being secured to the housing section.

Now, the function of the security device 10 according to the embodiment illustrated in FIGS. 1-6 will be described.

Firstly, the security device 10 with the clasping member is placed around the object to be secured. Thereby the support member 300 is adapted to receive portions of cables 110, 120 opposite ends 112, 114, 122, 124 of the cables and to be placed with its upper surface 310 below a bottom surface of the object to be secured.

Then, using the gripping element 222 in the manoeuvring member 220 and turning it in the non-locking direction will narrow the loop formed by the cables 110 and 120 until the circumference of the loop is adjusted to the circumference of the object, such that the cables 110, 120 of the clasping members tightly enclose the object and such that the support member 300 tightly engages the bottom surface of the object. In this position, the object is regarded as secured. Since the latch members 231, 232 are arranged to be inclined towards the protruding profile 292 of the gear member 290 such that they glide along the teeth of the protruding element no locking action will be achieved by the rotation of the manoeuvring element 220 relative the gear member 290 in the non-locking direction.

It may be mentioned that the support member 300 is not necessary in order to secure the object. This may still be achieved only with the combination of the clasping member 100 and the locking member 200 tightly enclosing the object to be secured in a tight loop. This loop may comprise the two ends of the clasping member 100 secured in the manoeuvring member 220. In order to achieve higher security the cables 110, 120 of the clasping member may be coated by or comprise an outer layer of high friction, such as, for example rubber.

Here it may be added that the narrowing of the loop is achieved through the transfer of rotation from the manoeuvring member 220 to the activation element 280 which in turn effectuates rotation of the drum 260 relative to the gear member 290. This rotation of the manoeuvring member 220 effectively winds the cables 110, 120 around the circumferential surface 261 of the drum 260.

At the secured position, the latch members 231, 232, due to their inclination towards the plane in which the protruding profile 292 is located, will be locked into the teeth of the protruding profile 292. Hence, widening of the cable loop by attempting to use the gripping portion 222 of the manoeuvring member will not be possible. As described earlier, the widening of the cable loop may be possible by using a magnetic detacher.

A forceful attempt to free the object thus secured by for example attempting to cut one of the cables 110, 120 will immediately break the alarm circuit and activate the alarm by discharging the capacitor 228 and supplying the discharge current to the sound chamber 270 producing an alarm sound.

Figure 5:
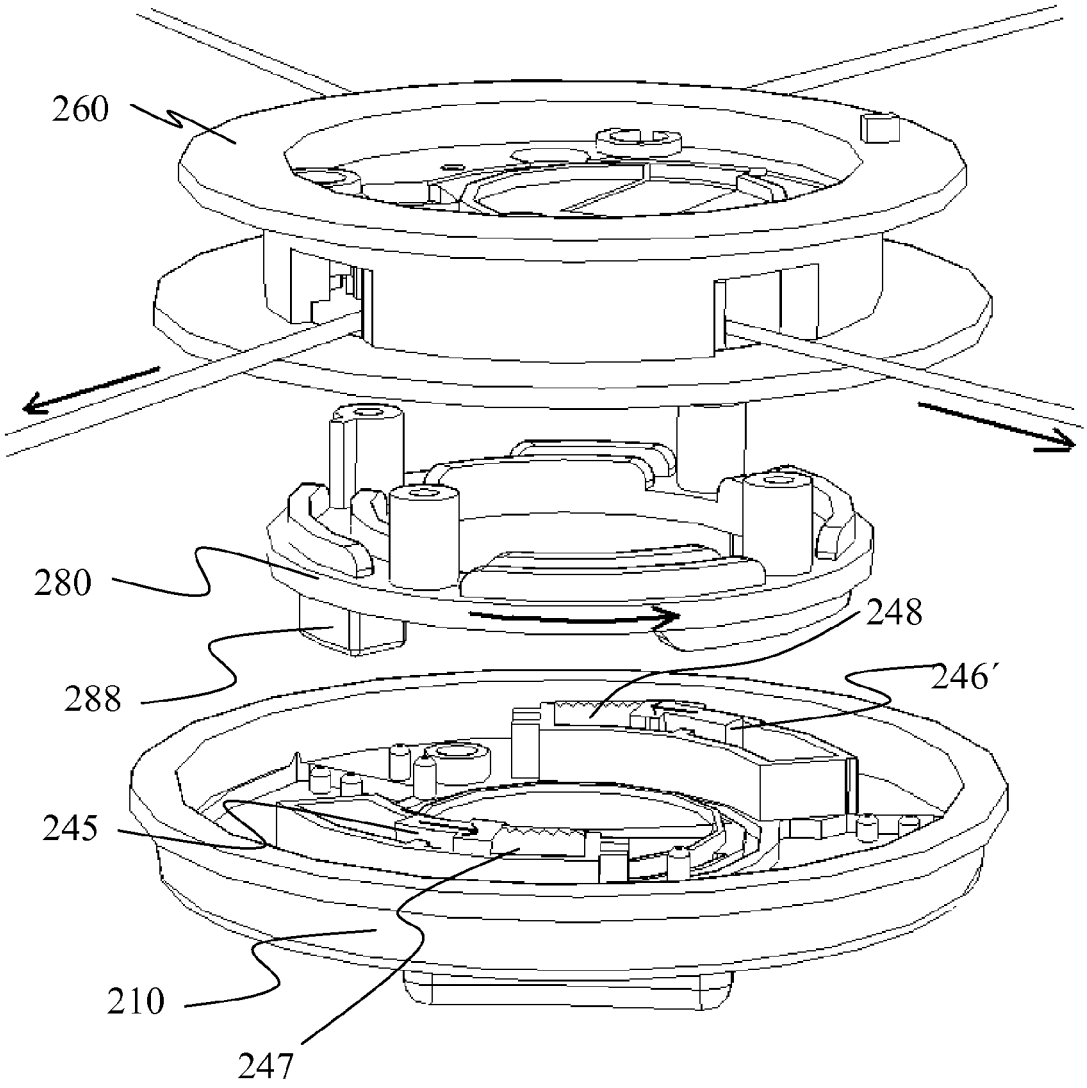
FIG. 5 illustrates the part of the locking member from FIG. 3 with the alarm activated.
Figure 6:
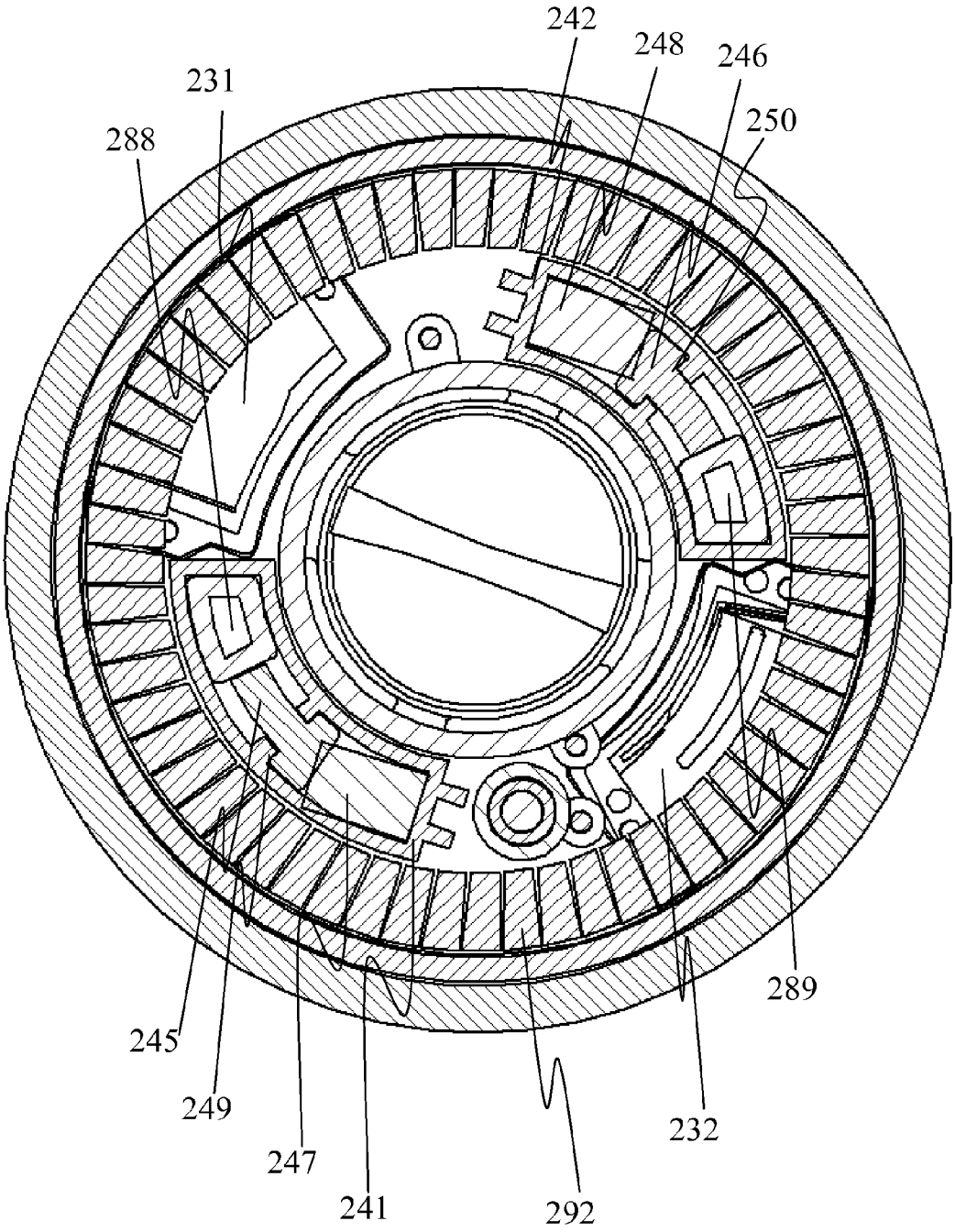
FIG. 6 illustrates a sectional view of the security device according to the present invention seen from below with the alarm not activated.
Figure 7:
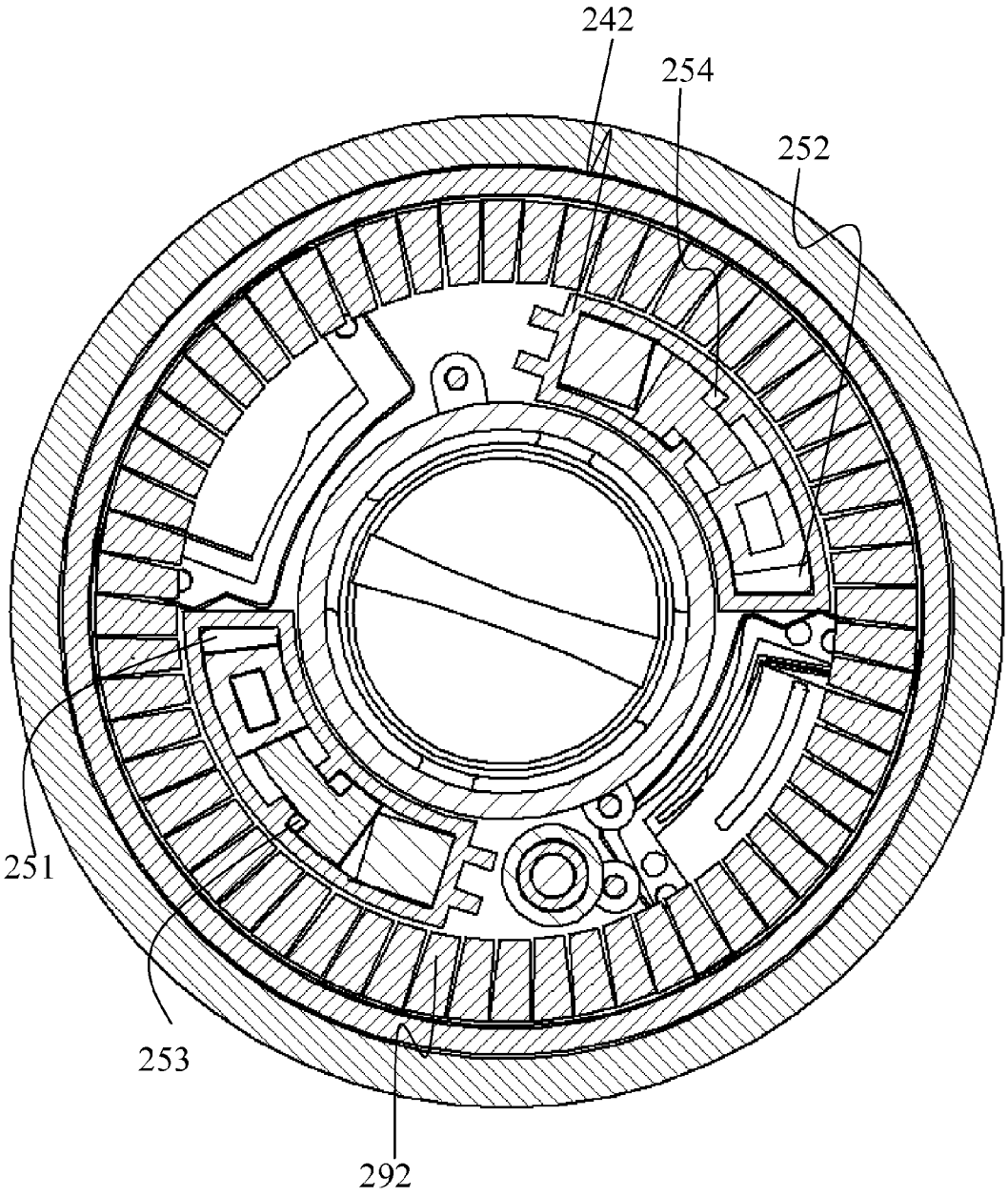
FIG. 7 illustrates a sectional view of the security device from FIG. 5 with the alarm activated.

However, the security device according to the present invention is also protected against attempts to pull out one or more of the cables 110, 120 of the clasping member out of the openings 262, 263 of the second main part 260. This is achieved as follows: If an external pulling force illustrated by the arrows next in the upper part of FIG. 5 is applied to the cables 110, 120 of the clasping member when they are tight and secured around an object to be protected a pulling force will cause a displacement 251, 252 of the activation elements 288, 289 in the direction of the arrow in the middle part of FIG. 5 and thereby a displacement 253, 254 of the T-shaped movable elements 245, 246 in the direction of the arrow in the lower part of FIG. 5. If the pulling force is strong enough it will cause the displacement of the T-shaped movable elements away from the alarm contacts 249, 250 and a contraction of the elastic elements 247, 248 as shown in FIGS. 5 and 7. However, since the alarm contacts 249, 250 and the T-shaped movable elements 245, 246 were in electrical contact in the situations depicted in FIGS. 4 and 6 and this contact is broken, the use of the external pulling force will break the alarm circuit and activate an alarm signal. It should also be mention that it may be possible to realize the security device 10 also without the T-shaped movable members 245, 246.

In this case, the activation member 280 may be constructed so that at least a part of the activation elements 288, 289 is in electrical contact with the alarm contacts 249, 250 and that the activation member 280 also forms part of the alarm circuit. Then, when an outer pulling force is applied to the cables 110, 120 the activation elements 288, 289 of activation member 280 are displaced towards the elastic elements 247, 248, the electrical contact between the activation elements 288, 289 and the alarm contacts 249, 250 is broken and the alarm signal is activated.

Thus attempts to remove the object secured by the cables 110, 120 of the clasping member 100 by widening the loop formed by it using a pulling force will be safely prevented. The clasping member 100 may in order to increase security be flexible and at the same time resilient to pulling forces.

In order to avoid false alarms, the material of the elastic elements 247, 248 may be chosen so as to not to be contracted when accidentally pulling one of the cables 110, 120 of the clasping element 100. However, the material may be chosen, such that the elastic elements 247, 248 contract when a moderate pulling force is exerted on the cables 110, 120 thereby activating the alarm signal.

Also, the elastic elements 247, 248 may be present in the form of a rubber element, such as a rubber hose, an elastic plastic element or a spring element. The T-shaped movable elements 247, 248 may preferably be rigid and partly made of plastic and partly of a conducting material. The conducting side may then in the "no-alarm" state be connected to the alarm contacts 249, 250.

It may be understood that there may be many other embodiments of the present invention which may be plausible to a skilled person having read the above description. Ultimately, the scope of the present invention is only limited by the wording of the accompanying patent claims.

The invention claimed is:

1. A security device comprising:

a clasping member for enclosing an object to be secured, the clasping member comprising a conducting member;

a locking member connected to the clasping member, such that the locking member and the clasping member form a loop, the locking member in turn comprising:

a gear member comprising a protruding profile, the gear member extending in a first plane with the protruding profile raised from the first plane, a manoeuvring member extending in a second plane parallel to the first plane, the manoeuvring member being rotatable relative the gear member and comprising a latch member biased towards the first plane arranged to engage the gear member, such that rotation of the manoeuvring member in one direction causes a narrowing of the loop whereas rotation in the opposite direction causing a widening of the loop is prevented through the engagement of the latch member with the protruding profile, the security device further comprising a drum for winding up the clasping member such that rotation of the manoeuvring member causes rotation of the drum and thereby adjustment of the width of the loop, the clasping member and the locking member further forming part of an alarm circuit, wherein the locking member further comprises a movable element electrically connected to the alarm circuit and positioned next to an elastic element, so that an external pulling force applied to the clasping member with the latch member locked in one of protrusions of the protruding profile causes a movement of the movable element towards the elastic element deforming the latter thereby interrupting the alarm circuit and activating an alarm signal.

2. The security device according to claim 1, wherein the locking member further comprises an activation member arranged to engage the drum and the manoeuvring member, such that the external pulling force exerted on the clasping member urges the activation member to move the movable element and thereby deform the elastic element.

3. The security device according to claim 2, wherein the manoeuvring member comprises a groove housing the movable element and the elastic element, the groove further comprising a space arranged to receive an activation &lenient of the activation member, the activation member being arranged to move the movable element and thereby deform the elastic element when the external pulling force is exerted on the clasping member.

4. The security device according to claim 1, where the movable element comprises an electrically conducting part in electrical contact with an alarm contact arranged in the locking member.

5. The security device according to claim 1, wherein the movable element is rigid.

6. The security device according to claim 1, wherein the elastic element comprises one of rubber element, foam, plastic or elastic spring.

7. The security device according to claim 2, wherein the manoeuvring member comprises a groove housing the movable element and the elastic element, the groove further comprising a space arranged to receive an activation element of the activation member, the activation member being arranged to move the movable element and thereby deform the elastic element when the external pulling force is exerted on the clasping member.

8. The security device according to claim 2, where the movable element comprises an electrically conducting part in electrical contact with an alarm contact arranged in the locking member.

9. The security device according to claim 2, wherein the movable element is rigid.

10. The security device according to claim 9, wherein the manoeuvring member comprises a groove housing the movable element and the elastic element, the groove further comprising a space arranged to receive an activation element of the activation member, the activation member being arranged to move the movable element and thereby deform the elastic element when the external pulling force is exerted on the clasping member.

11. The security device according, to claim 2, wherein the elastic element comprises one of rubber element, foam, plastic or elastic spring.

12. The security device according to claim 11, wherein the manoeuvring member comprises a groove housing the movable element and the elastic element, the groove further comprising a space arranged to receive an activation element of the activation member, the activation member being arranged to move the movable element and thereby deform the elastic element when the external puffing force is exerted on the clasping member.

13. The security device according to claim 11, where the movable element comprises an electrically conducting part in electrical contact with an alarm contact arranged in the locking member.

* * * * *

UNITED STATES PATENT AND TRADEMARK OFFICE

CERTIFICATE OF CORRECTION

PATENT NO. : 8,528,372 B2
APPLICATION NO. : 13/055065
DATED : September 10, 2013
INVENTOR(S) : Thomas Nilsson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 299 days.

Signed and Sealed this
Fifteenth Day of September, 2015

Michelle K. Lee

Michelle K. Lee
*Director of the United States Patent and Trademark Office*